US011794090B2

(12) United States Patent
Fagerberg

(10) Patent No.: US 11,794,090 B2
(45) Date of Patent: Oct. 24, 2023

(54) WHEELED VEHICLE AND DECK FOR WHEELED VEHICLE

(71) Applicant: Richard Patrick Fagerberg, Austin, TX (US)

(72) Inventor: Richard Patrick Fagerberg, Austin, TX (US)

(73) Assignee: ACME LAND SURF CO., LLC, Austin, TX (US)

( * ) Notice: Subject to any disclaimer, the term of this patent is extended or adjusted under 35 U.S.C. 154(b) by 328 days.

(21) Appl. No.: 17/144,855

(22) Filed: Jan. 8, 2021

(65) Prior Publication Data

US 2021/0205692 A1 Jul. 8, 2021

Related U.S. Application Data

(60) Provisional application No. 62/958,550, filed on Jan. 8, 2020.

(51) Int. Cl.

| | |
|---|---|
| ***A63C 17/12*** | (2006.01) |
| ***A63C 17/01*** | (2006.01) |
| ***A63C 17/22*** | (2006.01) |
| *A63C 17/26* | (2006.01) |

(52) U.S. Cl.

CPC ..... *A63C 17/12* (2013.01); *A63C 17/016* (2013.01); *A63C 17/226* (2013.01); *A63C 17/26* (2013.01); *A63C 2203/12* (2013.01)

(58) Field of Classification Search

CPC ..... A63C 17/12; A63C 17/016; A63C 17/26; A63C 2203/12; A63C 17/08; A63C 17/068; A63C 17/28

See application file for complete search history.

(56) References Cited

U.S. PATENT DOCUMENTS

| | | | | |
|---|---|---|---|---|
| 4,073,356 A * | 2/1978 | Schlicht | ..... | A63C 17/01 180/181 |
| 4,795,181 A * | 1/1989 | Armstrong | ..... | A63C 17/012 D21/765 |
| 7,479,097 B2 * | 1/2009 | Rosborough | ..... | A63B 22/203 482/146 |
| D769,997 S | 10/2016 | Doerksen | | |

(Continued)

FOREIGN PATENT DOCUMENTS

| | | |
|---|---|---|
| CN | 108933498 A | 12/2018 |
| DE | 212017000154 U1 | 1/2019 |

(Continued)

*Primary Examiner* — Frank B Vanaman
(74) *Attorney, Agent, or Firm* — Brian F. Russell

(57) ABSTRACT

A stand-up wheeled vehicle may include an electrically powered wheel and a deck configured to limit a maximum value of an angle of declination of the deck in a forward direction of travel, for example, to less than about 20 degrees, 15 degrees, 10 degrees, or 8 degrees. The deck may be asymmetric, such that a length of a first portion of the deck between the wheel and a first end of the deck is greater than a length of a second portion of the deck between the wheel and a second end of the deck. The deck may include a first surface, an opposing second surface, and a chassis disposed in the second surface. The chassis may have a cavity formed therein configured to receive a stand-up wheeled vehicle. A coupling mechanism may be utilized to removably retain the stand-up wheeled vehicle in the cavity of the chassis.

13 Claims, 8 Drawing Sheets

(56) References Cited

U.S. PATENT DOCUMENTS

| | | | | |
|---|---|---|---|---|
| 9,968,841 | B2 | 5/2018 | Doerksen | |
| D821,517 | S | 6/2018 | Doerksen | |
| 10,112,680 | B2 | 10/2018 | Doerksen et al. | |
| D843,532 | S | 3/2019 | Doerksen | |
| 10,272,319 | B2 | 4/2019 | Doerksen et al. | |
| D850,552 | S | 6/2019 | Doerksen | |
| 10,307,660 | B2 | 6/2019 | Doerksen et al. | |
| 2005/0241864 | A1* | 11/2005 | Hiramatsu | A63C 17/004 180/181 |
| 2007/0254789 | A1* | 11/2007 | Odien | A63B 26/003 482/92 |
| 2012/0187648 | A1* | 7/2012 | Chen | A63C 17/0033 280/87.042 |
| 2013/0049317 | A1* | 2/2013 | Cheek | A63C 17/006 280/87.042 |
| 2017/0259162 | A1* | 9/2017 | Mo | A63C 17/12 |
| 2018/0161661 | A1* | 6/2018 | Ma | A63C 17/1418 |
| 2019/0299082 | A1* | 10/2019 | Hoover | A63C 17/08 |

FOREIGN PATENT DOCUMENTS

| | | | |
|---|---|---|---|
| WO | 2018081315 | A1 | 5/2018 |
| WO | 2019099730 | A1 | 5/2019 |
| WO | 2019109102 | A1 | 6/2019 |
| WO | 2019113128 | A1 | 6/2019 |
| WO | 2019113537 | A1 | 6/2019 |

* cited by examiner

WHEELED VEHICLE AND DECK FOR WHEELED VEHICLE

BACKGROUND OF THE INVENTION

The present invention relates in general to personal wheeled vehicles, and in particular, to a stand-up wheeled vehicle and a deck for a stand-up wheeled vehicle.

Stand-up wheeled vehicles, such as skateboards, electric scooters, hoverboards, and the like, have enjoyed widespread adoption for transportation, recreation, and entertainment. In addition to being relatively low in cost and easy to carry, store, and maintain, these stand-up wheeled vehicles also serve to provide enjoyment to the rider. This enjoyment stems from the significant freedom of movement experienced by the rider and the capacity for the rider to engage in self-expression and demonstrations of the rider's skill as the rider encounters various obstacles, structures, and riding surfaces, particularly in a dynamic environment.

BRIEF SUMMARY

According to various embodiments, a deck for a stand-up wheeled vehicle and an improved stand-up wheeled vehicle are provided. In some embodiments, the stand-up wheeled vehicle may be convertible between multiple different form factors by the application of a supplemental deck.

In at least one embodiment, a stand-up wheeled vehicle may include an electrically powered wheel and a deck configured to limit a maximum value of an angle of declination of the deck in a forward direction of travel, for example, to less than about 20 degrees, and in some embodiments, less than about 15 degrees, and in some embodiments, less than about 10 degrees, and even more particularly, less than about 8 degrees. The deck may be asymmetric along its long axis, such that a length of a first portion of the deck between the wheel and a first end of the deck is greater than a length of a second portion of the deck between the wheel and a second end of the deck. The deck may include a first surface, an opposing second surface, and a chassis disposed in the second surface. The chassis may have a cavity formed therein configured to receive a stand-up wheeled vehicle. A coupling mechanism may be utilized to removably retain the stand-up wheeled vehicle in the cavity of the chassis.

Additional embodiments are disclosed herein.

In the following discussion, like and corresponding reference numbers are utilized to identify the same or similar elements in various embodiments. Elements are generally identified utilizing three-digit numbers, with the first digit identifying the number of the figure by reference to which the element is first described.

DETAILED DESCRIPTION

Figure 1:
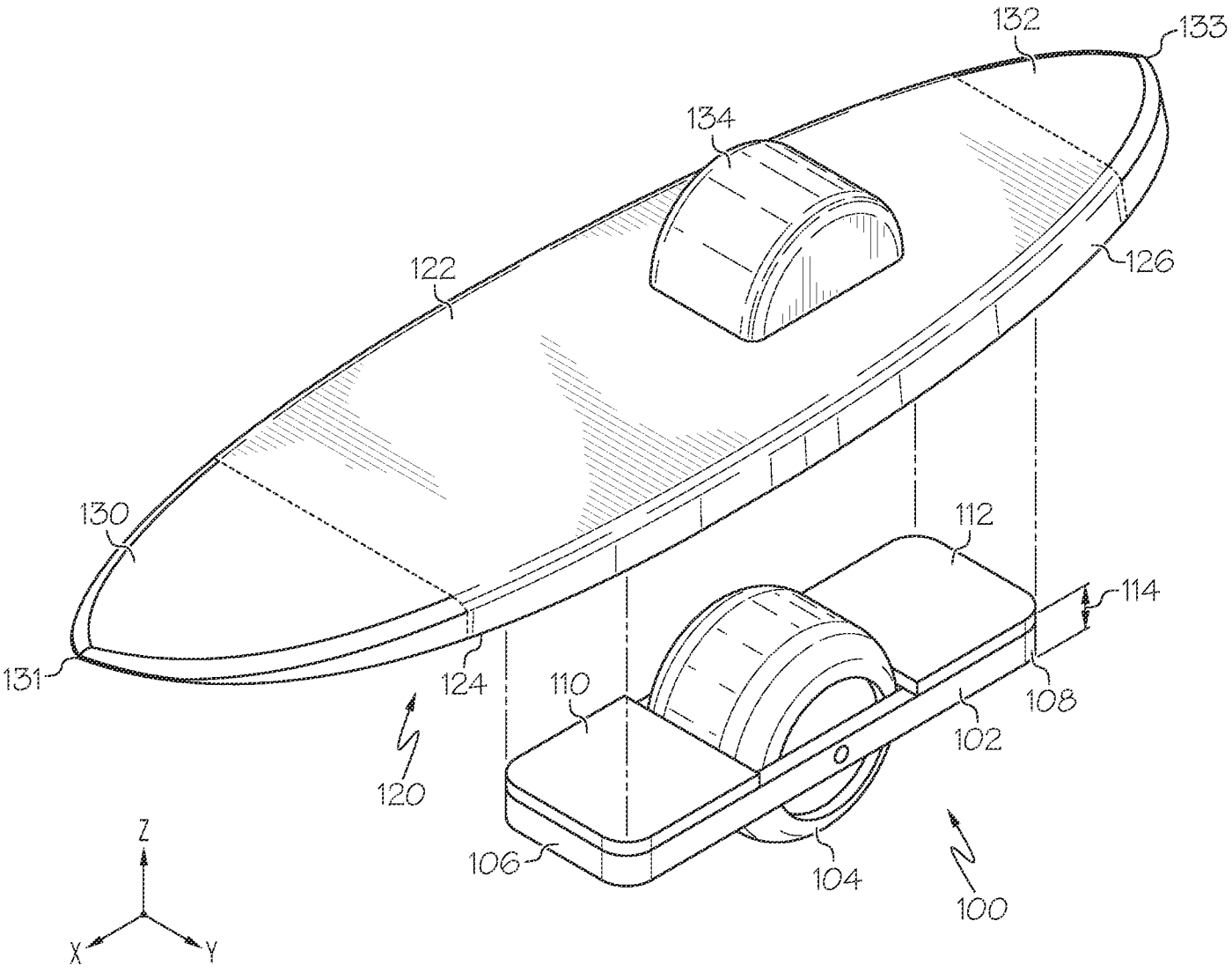
FIG. 1 is a top isometric view of a stand-up wheeled vehicle and a vehicle deck for a stand-up wheeled vehicle in accordance with one embodiment.
Figure 2:
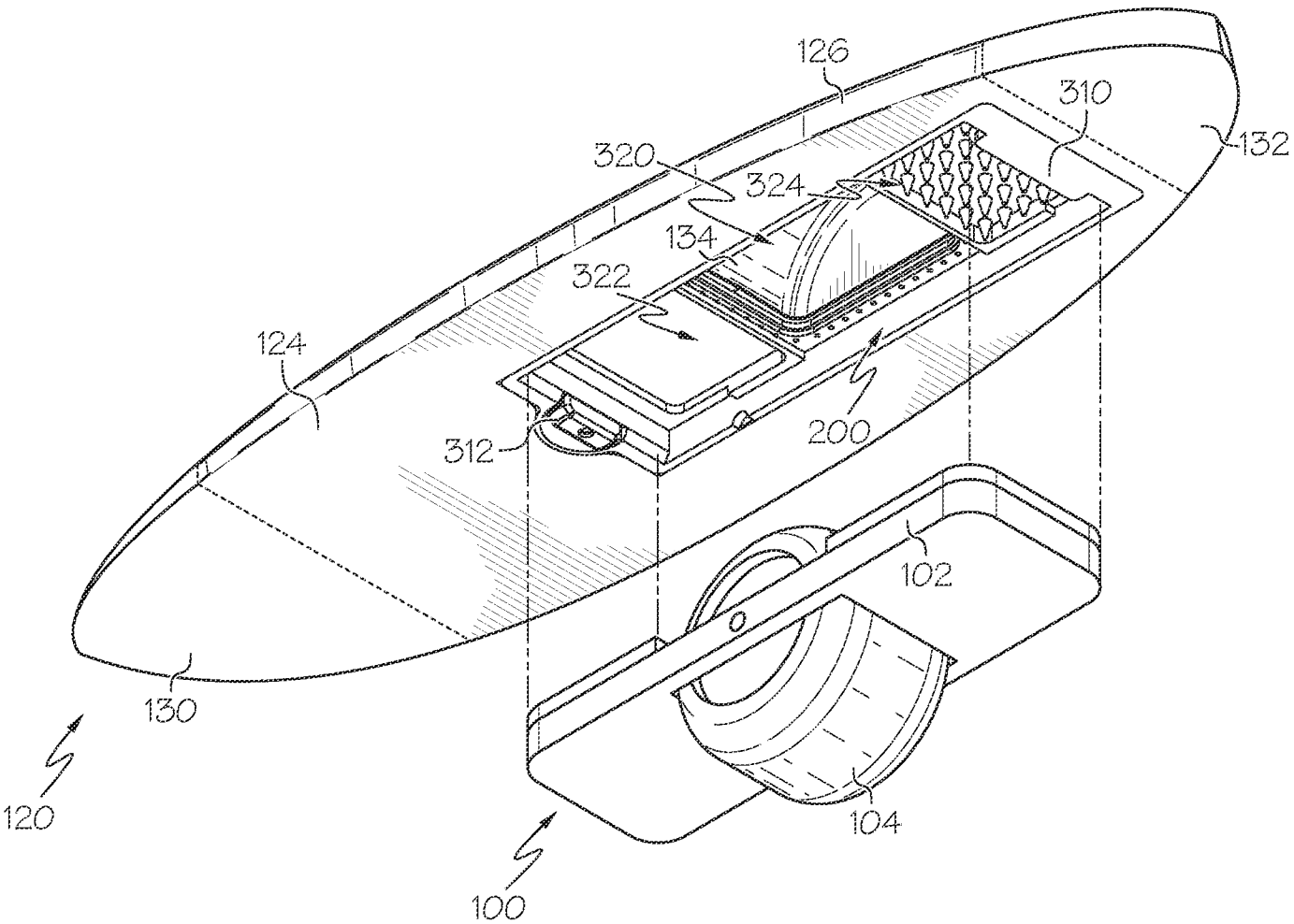
FIG. 2 is a bottom isometric view of a stand-up wheeled vehicle and a vehicle deck for a stand-up wheeled vehicle in accordance with one embodiment.

With reference now to the figures and in particular with reference to FIGS. 1-2, top and bottom isometric views of a stand-up wheeled vehicle 100 and a vehicle deck 120 for a stand-up wheeled vehicle are illustrated in accordance with one embodiment. As depicted, in this embodiment, stand-up wheeled vehicle 100 has the general form of a single-wheeled electric skateboard, such as a OneWheel® electric skateboard available from Future Motion Inc., a Geo-Blade™ 500 electric skateboard from Hoverboard Technologies, or a Roll™ electric skateboard from Jyro. In this example, stand-up wheeled vehicle 100 generally includes a frame 102 coupled to centrally located, electrically (i.e., battery) powered, gyroscopically balanced wheel 104. Frame 102, which is generally symmetrical about wheel 104, includes a front end 106 and a rear end 108. Stand-up wheeled vehicle 100 additionally includes a first (or front) foot pad 110 supported by frame 102 between wheel 104 and front end 106 and a second (or rear) foot pad 112 supported by frame 102 between wheel 104 and rear end 108.

In preferred embodiments, at least one (and possibly both) of foot pads 110 and 112 is pressure-sensitive. In such embodiments, based upon sensing application of pressure signifying the weight of a rider on foot pad(s) 110 and/or 112, the internal control circuitry of stand-up wheeled vehicle 100 (not separately illustrated) senses presence of a rider and accordingly automatically switches stand-up wheeled vehicle 100 from an inactive state in which wheel 104 is stationary to an active state in which wheel 104 can be rotated under electrical power. The angular acceleration at which wheel 104 is rotated is generally determined by the control circuitry of stand-up wheeled vehicle 100 based, at least in part, by the angle of declination imparted by the rider to frame 102. Thus, a rider standing on foot pads 110 and 112 can maintain stand-up wheeled vehicle 100 in a stationary position if frame 102 is maintained generally level. The rider can accelerate stand-up wheeled vehicle 100 in the forward or reverse direction by downwardly tipping the front end 106 or rear end 108, respectively.

Those skilled in the art will appreciate that in embodiments other than that shown in FIGS. 1-2 the stand-up wheeled vehicle may have more than one wheel. In such embodiments, the wheels can be substantially in line with the direction of travel of the stand-up wheeled vehicle or can be along a line orthogonal to the direction of travel. Further, in some alternative embodiments, the stand-up wheeled vehicle can have one or more foot pads or foot rests that, in contrast to the embodiment of FIG. 1, is/are orthogonal to the direction of travel of the stand-up wheeled vehicle such that, when riding, the rider's body is forward-facing rather than sideways-facing.

For ease of understanding, in the following discussion, reference is made to a geocentric coordinate system defined by mutually orthogonal X, Y, and Z axes, where the X and Y axes are parallel with a level surface of the earth and the Z axis extends radially from the earth's core. In the following discussion, elements may be described as "above" (or "upper") or "below" (or "lower"), meaning having a greater displacement or lesser displacement along the Z axis, respectively, while in a given orientation. Similarly, elements may be described as "forward" (or "front") or "backward" (or "rear"), meaning having a greater displacement or lesser displacement along the X axis, respectively, while in a given orientation. Those skilled in the art will appreciate that any references herein to this geocentric coordinate system are made for purposes of explanation rather than of limitation.

Stand-up wheeled vehicles like stand-up wheeled vehicle 100 or the alternative embodiments described above are commonly subject to a "nosedive" condition in which frame 102 tilts forward or backward at an angle that exceeds the rider's ability to remain standing on the foot pads (e.g., footpads 110 and 112 of FIG. 1). A nosedive condition can be caused by any one or a combination of factors, including, for example, the rider's loss of balance, too aggressive acceleration or deceleration, loss of battery power by the stand-up wheeled vehicle, programming error or hardware fault in the control circuitry of the stand-up wheeled vehicle. In the nosedive condition, frame 102 may have an angle of declination with respect to the X-Y plane of about 20 degrees or greater. The angle of declination achieved in the nosedive condition is frequently limited only by the contact of frame 102 and the underlying substrate and can be 30 degrees or greater. All too often, a stand-up wheeled vehicle entering a nosedive condition results in the rider falling from the stand-up wheeled vehicle and possibly sustaining injury from impact with the substrate or objects or people in the surrounding environment.

In accordance with one or more embodiments, an improved deck 120 for a stand-up wheeled vehicle 100 is provided. In at least some embodiments, deck 120 has the general appearance of a modified surfboard. Deck 120, which extends between a first end 131 and a second end 133, comprises a body having at least a nose portion 130, a central portion, and a tail portion 132, as well as an upper surface 122 and a lower surface 124. In at least some embodiments, deck 120 may optionally further include side edges 126. (For example, distinct side edges 126 may be omitted in at least some embodiments depending on the edge-to-edge taper of the thickness of deck 120.) The upper surface 122 of the central portion of deck 120 between nose portion 130 and a tail portion 132 may be approximately planar in at least some embodiments. Nose portion 130 and tail portion 132 may have a variety of shapes and contours in various embodiments. In at least some embodiments, deck 120 additionally includes an enclosed wheel well 134 sized to house at least a portion of wheel 104 of stand-up wheeled vehicle 100. In other embodiments, enclosed wheel well 134 may be omitted, and a portion of wheel 104 may extend above upper surface 122 of deck 120. Deck 120 may be formed, for example, of fiberglass, foam, plastic, wood, plywood, or a combination of any of these or other materials having a durability and rigidity suitable to serve as a deck of a stand-up wheeled vehicle. In at least one embodiment, deck 120 has an overall length between first end 131 and second end 133 along the X axis between about 100 and 215 cm, and more particularly, between about 150 and 200 cm, and still more particularly, between about 180 and 190 cm. Deck 120 may have a width along the Y axis at its widest point of between about 40 and 60 cm, and more particularly, between about 45 and 55 cm, and still more particularly, between about 50 and 55 cm.

As best seen in FIG. 2, in this embodiment deck 120 includes a chassis 200 that can be coupled to and decoupled from frame 102 of stand-up wheeled vehicle 100. In some embodiments, chassis 200 may be formed as a separate component and then incorporated into the body of deck 120 during manufacture. In other embodiments, chassis 200 is formed (e.g., molded and/or machined) integrally with the surrounding portions of deck 120.

Figure 3:
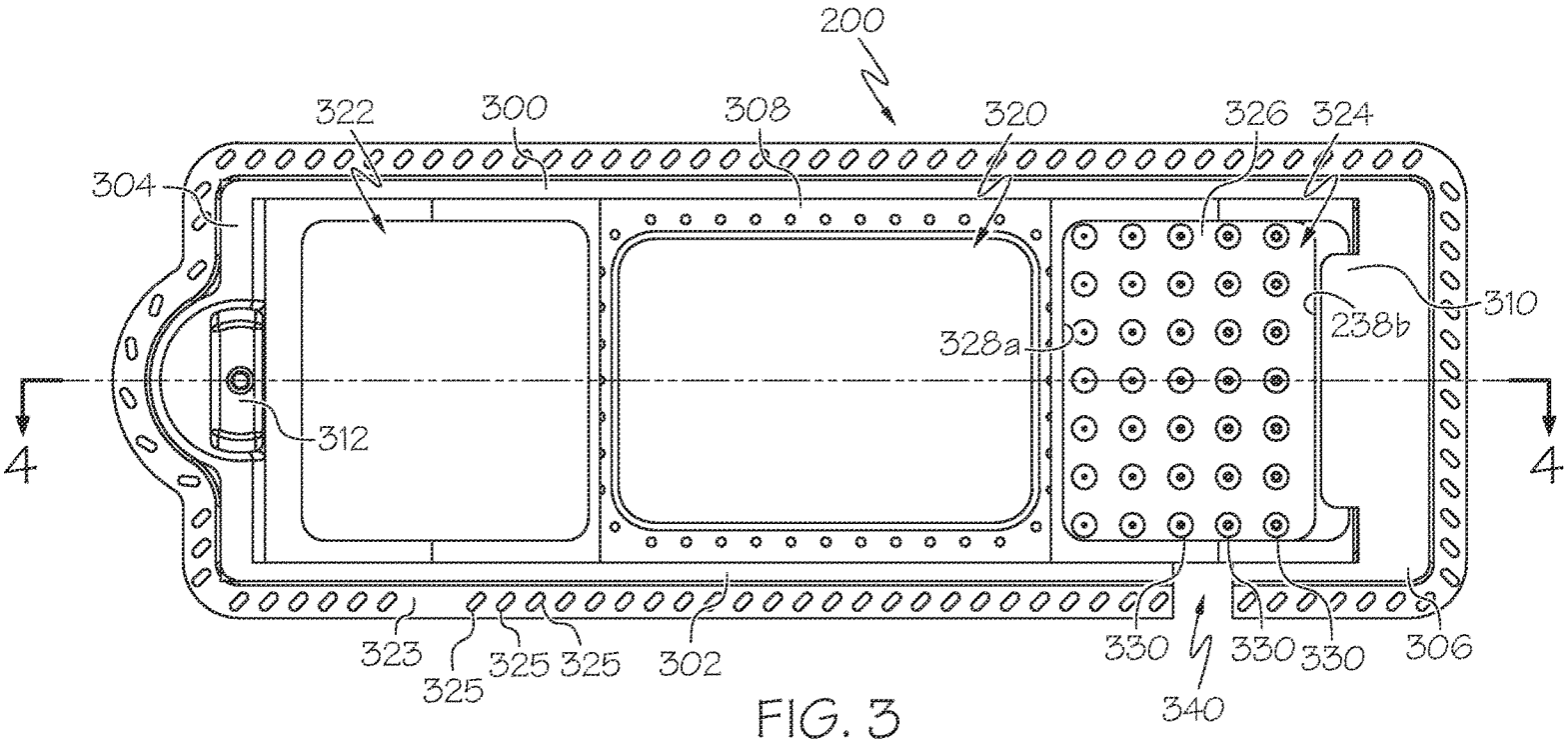
FIGS. 3, 4, and 5 respectively provide plan, section, and isometric views of a chassis for coupling a stand-up wheeled vehicle to a vehicle deck in accordance with one embodiment.
Figure 4:
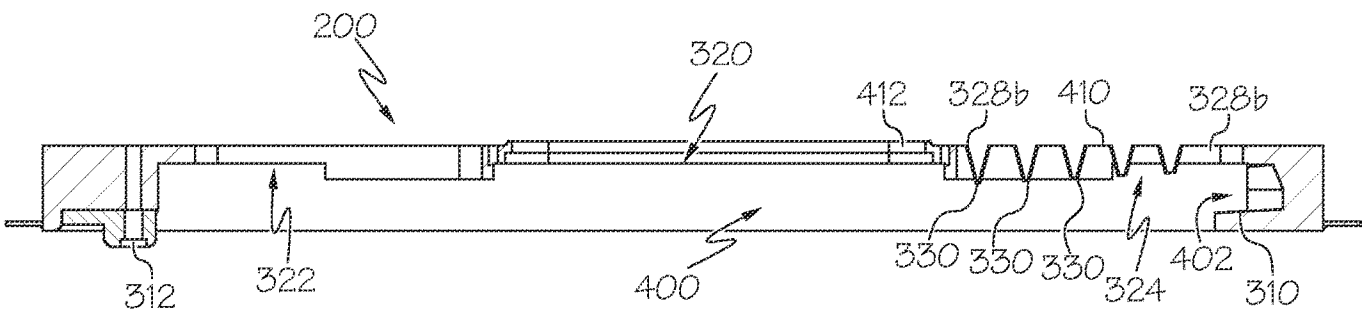
Figure 5:
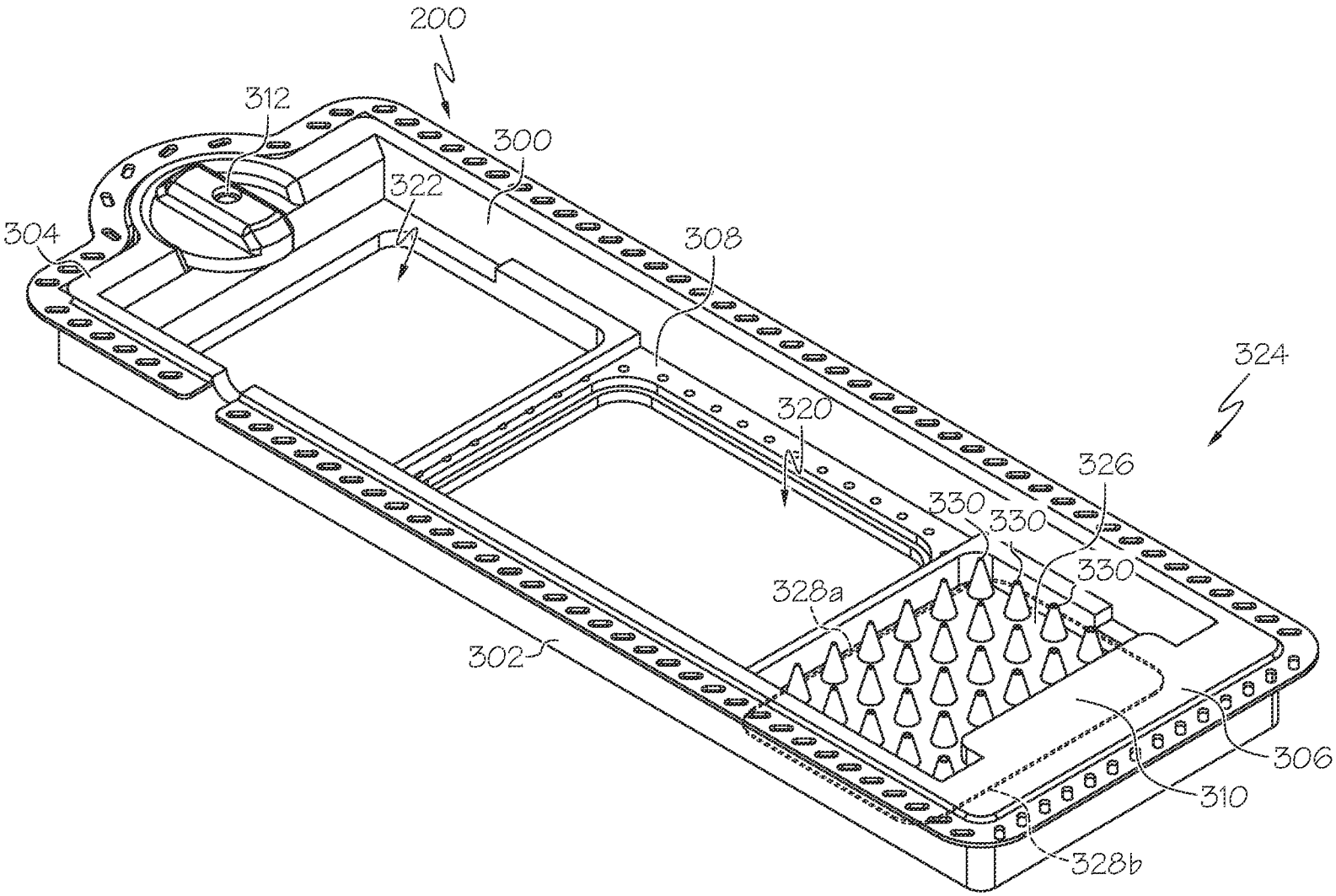

Reference is now made to FIGS. 3-5, which respectively illustrate plan, section, and isometric view of an exemplary chassis 200 for coupling a stand-up wheeled vehicle to a vehicle deck in accordance with one embodiment. In the depicted embodiment, chassis 200 includes a generally rectangular frame including two pairs of opposing sidewalls 300, 302 and 304, 306 and a partial plate 308 spanning the area enclosed by sidewalls 300-306. Partial plate 308 includes a through hole 320 corresponding in size and location to wheel well 134 in order to permit a portion of wheel 104 projecting above frame 102 to be received within and rotate freely within wheel well 134, if present. In this example, partial plate 308 also includes one or more additional through hole(s) 322 that permit the material utilized to form deck 120 (e.g., foam and/or fiberglass) to extend through partial plate 308 in order to provide a rigid connection between chassis 200 and the remainder of deck 120. Through hole(s) 325 may similarly be provided in a circumferential lip 323 about sidewalls 300-306 to further promote integration of chassis 200 with the remainder of deck 120. It should be appreciated in that some embodiments, chassis 200 can be formed (e.g., injection molded and/or machined) as a unitary piece with the remainder of deck 120, and that in such embodiments, through hole(s) 322 and 325 may be omitted.

The height of sidewalls 302, 304, 306, and 308 defines a cavity 400 within lower surface 124 of deck 120 into which frame 102 of stand-up wheeled vehicle 100 can be received. Cavity 400 of chassis 200 is preferably sized to receive therein at least a majority of, and more preferably, at least 75% of, and even more preferably, substantially all of the pad and frame height 114 of stand-up wheeled vehicle 100. In this example, sidewall 306 has at least one projection 310 extending from sidewall 306 into the area bounded by sidewalls 300-306 and forming a recess 402.

In the depicted embodiment, stand-up wheeled vehicle 100 can be retained within cavity 400 and thus coupled to deck 120 by placing rear end 108 of stand-up wheeled vehicle 100 within recess 402 and securing front end 106 within cavity 400 by manually rotating a rotatable latch 312 (e.g., 90 degrees) from an unlocked position (as shown in FIG. 3) to a locked position (as shown in FIG. 5). Stand-up wheeled vehicle 100 can decoupled from deck 120 simply by reversing this process, that is, by manually rotating rotatable latch 312 (e.g., 90 degrees) from the locked position shown in FIG. 5 to the unlocked position shown in FIG. 3 and by removing rear end 108 of stand-up wheeled vehicle 100 from recess 402. The coupling mechanism formed by the combination of projection 310 and latch 312 is advantageous in that no tools are required to couple stand-up wheeled vehicle 100 to deck 120 or to decouple stand-up wheeled vehicle 100 from deck 120. Those skilled in the art will appreciate that the illustrated coupling mechanism is but one of many possible design choices and that other embodiments may employ alternative coupling mechanisms, some of which may require tools and/or fasteners (e.g., bolts) to couple and decouple stand-up wheeled vehicle 100 and deck 120.

Figure 6A:
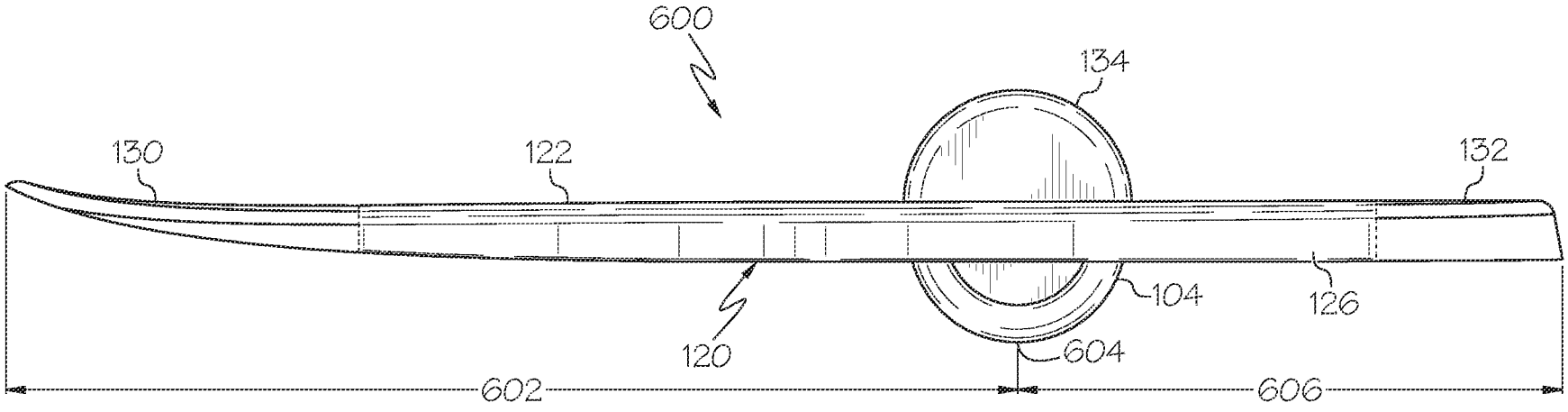
FIGS. 6A-6B are left side and right side elevation views of a fully assembled stand-up wheeled vehicle in accordance with one embodiment.
Figure 6B:
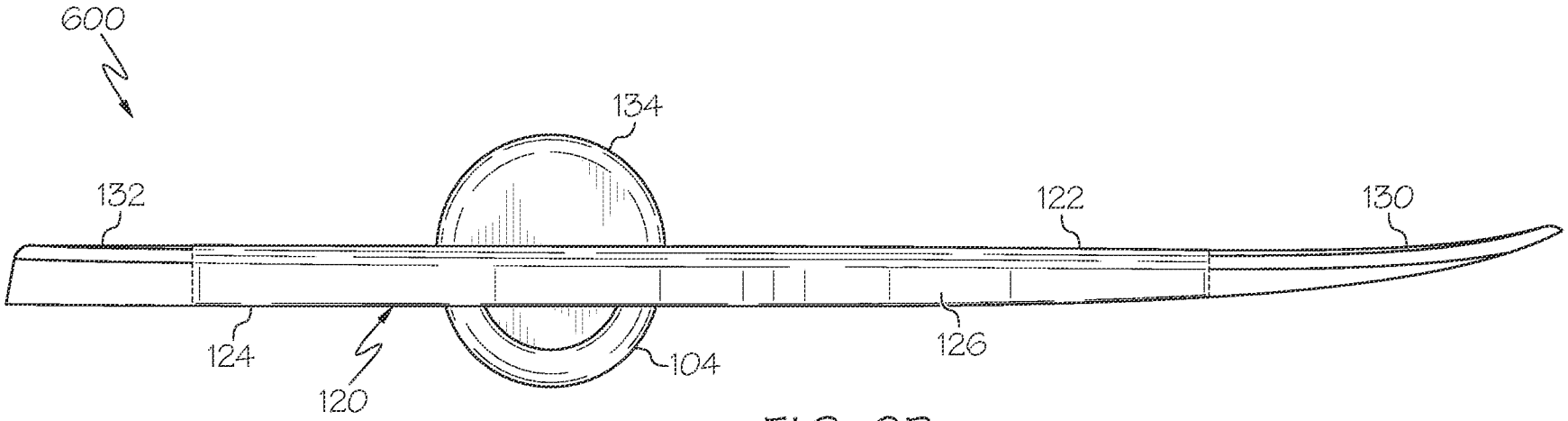
Figure 7A:
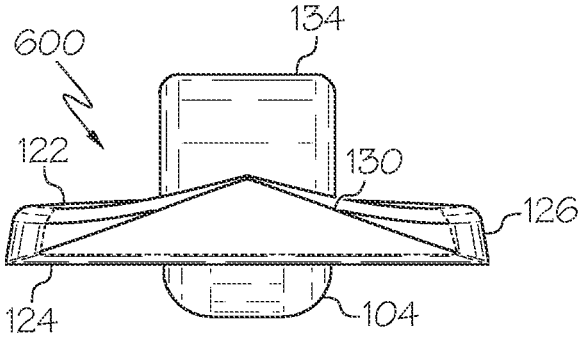
FIGS. 7A-7B are front and rear elevation views of a fully assembled stand-up wheeled vehicle in accordance with one embodiment.
Figure 7B:
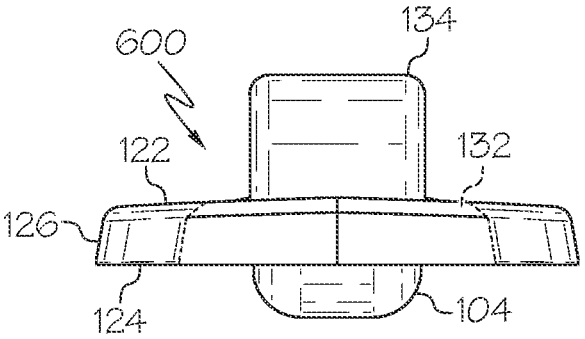

Referring now to FIGS. 6A-6B and FIGS. 7A-7B, left and right side elevation views and front and rear elevation views of an improved stand-up wheeled vehicle 600 comprising a stand-up wheeled vehicle 100 coupled to a deck 120 are depicted. As shown, stand-up wheeled vehicle 600 provides the seamless appearance of a motorized electric surfboard for land (as opposed aquatic) use. As best seen in FIGS. 6A-6B, deck 120 of stand-up wheeled vehicle 600 is asymmetric along the X axis. For example, a first length 602 of deck 120 between balance point 604 and the extremity of nose portion 130 is significantly greater than a second length 606 between balance point 604 and the extremity of tail portion 132. For example, in at least one embodiment, first length 602 is between about 300 percent and 200 percent, and more particularly, between 250 percent and 220 percent longer than second length 606. For example, in one specific embodiment, first length 602 may be between about 100 and 130 centimeters, and second length 606 may be between about 60 and 70 centimeters.

As a result of the asymmetric form of deck 120, stand-up wheeled vehicle 600 is biased toward a "nose down" position in which nose portion 130 is lower than tail portion 132. To compensate for this nose down position bias, a rider is likely to naturally adopt a "weight back" riding stance in order to place upper surface 122 in a substantially level position when stand-up wheeled vehicle 600 is in motion. This "weight back" riding stance, which mimics the posture of a surfer riding ocean waves, reduces the probability that the rider will lose his balance and be thrown from stand-up wheeled vehicle 600 in the event stand-up wheeled vehicle 600 achieves a nosedive condition or encounters a bump or other discontinuity in the smoothness of the underlying substrate.

Figure 8:
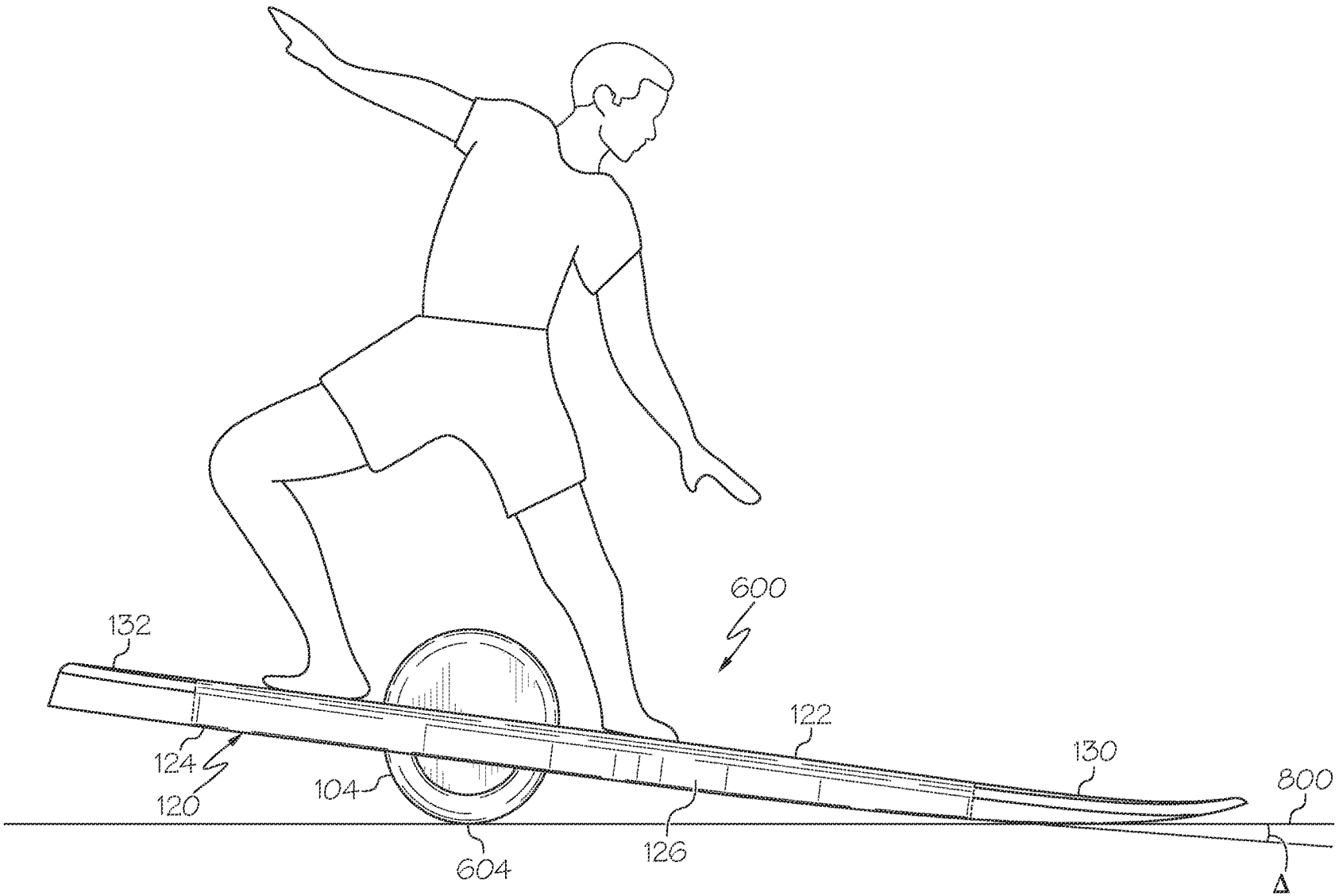
FIG. 8 depicts an exemplary stand-up wheeled vehicle in a nosedive condition.

With reference now to FIG. 8, there is illustrated an exemplary embodiment of a stand-up wheeled vehicle 600 in a nosedive condition. In this example, the lower surface 124 of at least a portion of nose portion 130 is in contact with underlying substrate 800. If desired, damage to lower surface 124 of deck 120 resulting from contact with substrate 800 can be mitigated, for example, through the application of replaceable skid pads to lower surface 124 and/or the incorporation within lower surface 124 of rollers or wheels (not illustrated) at point(s) of likely contact with substrate 800. As shown, the length 602 and contour of deck 120 forward of balance point 604 restricts the angle of declination A with respect to a level substrate 800 to a predetermined maximum value. In various embodiments, this maximum value of declination angle A may be less than about 20 degrees, and more particularly, less than about 15 degrees, or less than about 10 degrees, and still more particularly between about 8 degrees and about 5 degrees. Limiting the maximum value of declination angle A in this manner enhances rider confidence, control, and/or safety. Further, the rider is enabled to comfortably ride stand-up wheeled vehicle 600 in the nosedive condition and, if desired, selectively restore stand-up wheeled vehicle to a lesser degree of declination.

As noted above, one or more of foot pads 110, 112 may be pressure-sensitive and used to control whether stand-up wheeled vehicle 100 is in an inactive or active state. One technical challenge with combining an overlay deck, such as deck 120, with a stand-up wheeled vehicle 100 to form an improved stand-up wheeled vehicle 600 is that the pressure sensitivity of foot pads 110, 112 can be reduced or lost by covering foot pads 110, 112 with an overlay deck. As a consequence of the loss of pressure sensitivity, the control circuitry of stand-up wheeled vehicle 100 can fail to detect application of pressure to foot pads 110, 112 and thus fail to transition from an inactive state to an active state. Alternatively or additionally, the reduction of sensitivity of foot pads 110, 112 can unintentionally cause a "runaway" condition in which the removal of a rider's foot or feet from foot pads 110, 112 can fail to be sensed by the control circuitry of stand-up wheeled vehicle 100 and thus cause stand-up wheeled vehicle 100 to continue to be driven by its electrical motor (and even be accelerated), even without a rider aboard.

To address and overcome the technical challenge of a loss of pressure sensitivity resulting from overlaying foot pads 110, 112 with an overlay deck, several design options are available within the scope of the invention. In a first class of embodiments, the overlay deck can have one or more openings formed there through to expose at least a portion of one or more of foot pads 110, 112 and thus permit direct contact with foot pad(s) 110, 112. In a second class of embodiments, one or more overlay regions of the deck overlaying foot pads 110, 112 can be configured to be more flexible, for example, by forming these overlay region(s) of material(s), such as foam, that are more flexible than adjoining portions of the overlay deck and/or by reducing the thickness of the overlay regions relative to adjoining portions of the overlay deck and/or by partially detaching the overlay region(s) from adjoining portions of the overlay deck. In some of these embodiments, the elastic return of the overlay regions from a deformed condition can be additionally supported through the use of one or more springs (e.g., leaf spring(s)). In a third class of embodiments, the overlay deck can be specially configured to amplify and transmit pressure applied to the upper surface of the overlay deck to one or more of foot pads 110, 112.

Deck 120 is one example of this third class of embodiments. In particular, with reference again to FIGS. 2-5, in the depicted embodiment chassis 200 includes a pressure pad 324 configured to amplify and transmit pressure applied to upper surface 122 of deck 120 to rear foot pad 112. Pressure pad 324 is flexibly and resiliently coupled to partial plate 308 to permit movement of pressure pad 324 relative to partial plate 308. In the illustrated example, this flexibility and resiliency is achieved by appropriate selection of the properties of the materials (e.g., a plastic) from which pressure pad 324 is formed and by configuring pressure pad 324 with one or more free edges 328*a*, 328*b* at which pressure pad 324 is discontinuous with partial plate 308. The remaining material connecting pressure pad 324 and partial plate 308 can thus form a living hinge that enables pressure pad 324 to be deflected from a rest position and to then return to a the rest position under the inherent spring force of the material from which pressure pad 324 is formed.

As best seen in FIGS. 3-5, pressure pad 324 includes a lower surface 326 having a plurality of bosses (or protrusions) 330 extending therefrom. Bosses 330, which may optionally be arranged in a grid pattern, may each have a conical, frusto-conical, ovoid, or other form. Although not required, in at least some embodiments, it is preferred if bosses 330 have a generally tapered form. As best seen in FIG. 4, the extent that bosses 330 protrude from lower surface 326 can vary among the bosses 330, for example, to correspond to the contour of the surface of rear foot pad 112.

Pressure pad 324 additionally includes an upper surface 410. In the illustrated embodiment, upper surface 410 is planar and is stepped down slightly from the upper surface 412 of the central portion of partial plate 308 (see, e.g., FIG. 4). Consequently, when stand-up wheeled vehicle 100 is installed in cavity 400 without any pressure applied to upper surface 122 of deck 120, a small air gap exists between upper surface 410 of pressure pad 312 and the corresponding interior surface of deck 120.

With the illustrated configuration of chassis 200, when stand-up wheeled vehicle 100 is installed in cavity 400 of chassis 200, the pressure, if any, applied to rear foot pad 112 by deck 120 is preferably below the threshold required by the control circuitry of stand-up wheeled vehicle to transition from an inactive state to an active state. Thus, the force of gravity alone on deck 120 will not inadvertently cause stand-up wheeled vehicle 100 to transition from an inactive state to an active state, to accelerate, or to enter a "runaway" condition. However, when a rider stands on deck 120 of a stand-up wheeled vehicle 600 (for example, as shown in FIG. 8), the pressure applied by the rider to upper surface 122 of deck 120 elastically deforms deck 120 slightly, which causes the corresponding interior surface of deck 120 to impart downward pressure on upper surface 410 of pressure pad 324. This downward pressure is transmitted through bosses 330 to rear foot pad 312, allowing stand-up wheeled vehicle 100 to transition from an inactive state to an active state under the same or similar conditions as it would if deck 120 were not present. To this end, in at least some embodiments, it is preferred if the aggregate contact surface area of bosses 328 is selected to be significantly less than the surface area of upper surface 410 so that the pressure applied by the rider is not dissipated by the greater surface area of upper surface 122 of deck 120 relative to rear foot pad 112, but is instead mechanically amplified. For example, in one exemplary embodiment, the contact surface area of bosses 330 is between 5% and 30% of the surface area of upper surface 122, and more particularly, between 8% and 25% of the surface area of upper surface 122, and even more particularly, between 10% and 20% of the surface area of upper surface 122.

In at least some embodiments, it is desirable to be able to charge the internal battery of stand-up wheeled vehicle 100 or access control(s) (e.g., an on/off "power" button) of stand-up wheeled vehicle 100 without having to decouple stand-up wheeled vehicle 100 from deck 120. Accordingly, in some embodiments, deck 120 and/or chassis 200 may be include a relief 340 to facilitate direct access to a power port or control of stand-up wheeled vehicle 100 while installed in cavity 400. Alternatively or additionally, deck 120 and/or chassis 200 may include control(s) and/or port(s) electrically, mechanically, and/or communicatively coupled to corresponding control(s) and/or port(s) of stand-up wheeled vehicle 100 in order to extend access to these control(s) and/or port(s) without decoupling stand-up wheeled vehicle 100 from deck 120. For example, if stand-up wheeled vehicle 100 is equipped with an on/off power button, deck 120 may include a corresponding button (e.g., disposed on edge 126) mechanically linked to the on/off power button of a stand-up wheeled vehicle 100 installed in cavity 400. Similarly, if stand-up wheeled vehicle 100 is equipped with a power port, deck 120 may include a corresponding power port (e.g., disposed on edge 126) electrically connectable to the power port of stand-up wheeled vehicle 100 installed in cavity 400. In this second example, deck 120 may additionally house one or more supplemental battery packs that, by electrical connection (including wireless inductive connection) to the internal battery of stand-up wheeled vehicle 100, may be utilized to extend and/or enhance the range, power, and/or longevity of the internal battery of stand-up wheeled vehicle 100.

Deck 120 may include or be configured to include additional elements to enhance the appearance of deck 120 and/or the riding experience. For example, deck 120 may be equipped with a forward-facing, rear-facing, and/or downward-facing lighting system. In some embodiments, the lighting color and intensity can be rider-selectable, for example, utilizing a manually manipulable hardware control disposed in deck 120 or a software control, such as a mobile app in communication with a lighting control circuit disposed in deck 120. Deck 120 may alternatively or additionally include or provide a mount for one or more audio speakers (e.g., Bluetooth™ or other near-field network speaker(s)) and/or a video or still camera.

Figure 9:
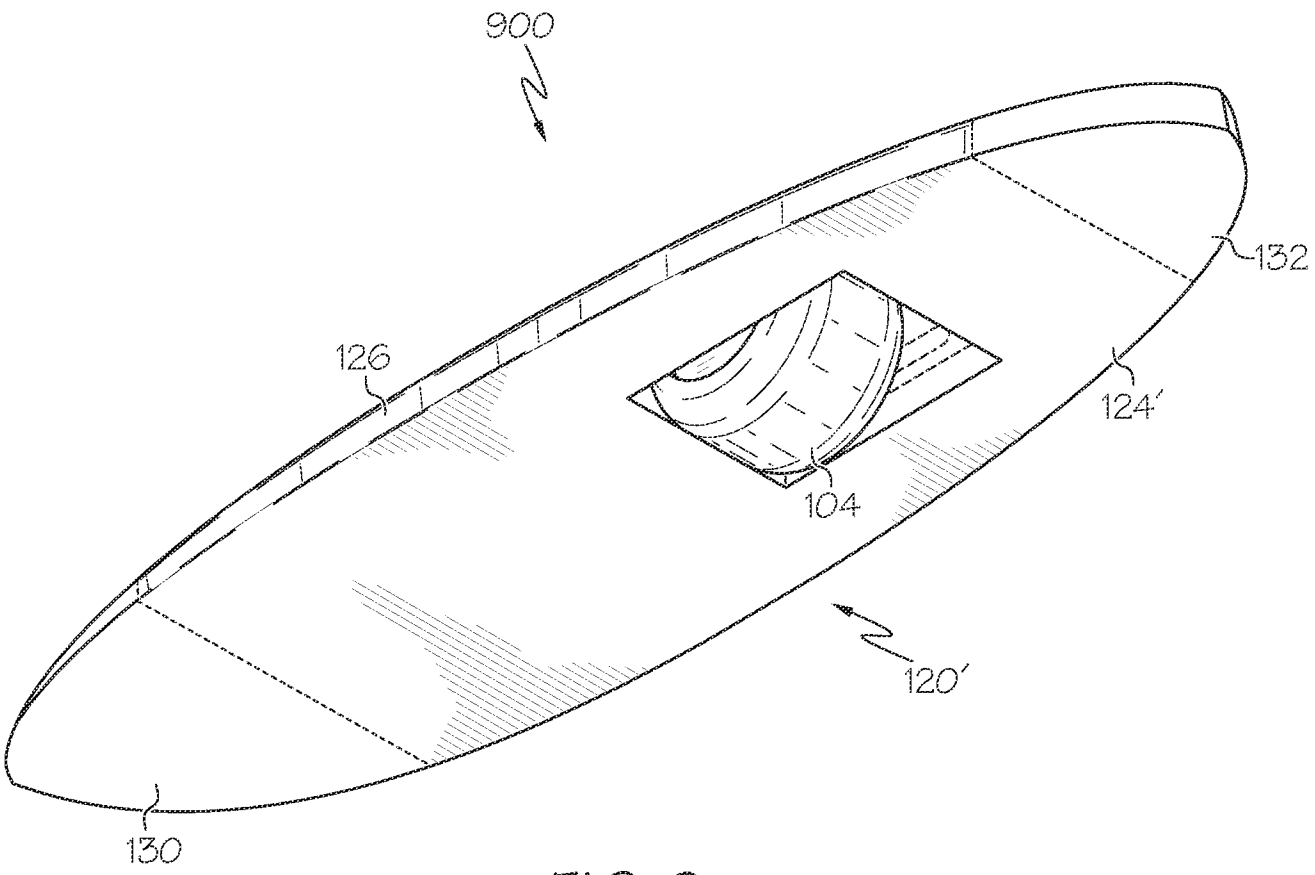
FIG. 9 illustrates an exemplary stand-up wheeled vehicle in accordance with another embodiment.

In the prior description, embodiments of a stand-up wheeled vehicle 600 including a separable stand-up wheeled vehicle 100 and deck 120 are described. In alternative embodiments, a stand-up wheeled vehicle 900 can instead have an integrated construction, as shown in FIG. 9. As indicated by like reference numerals, in this embodiment stand-up wheeled vehicle 900 can include a deck 120' and electrically (i.e., battery) powered, gyroscopically balanced wheel 104 generally as described above. However, unlike deck 120 of FIGS. 1-8, deck 120' of FIG. 9 does not include an exposed chassis 200 configured to receive and retain a separable stand-up wheeled vehicle 100. Instead, deck 120' incorporates, within its body, a frame for mounting wheel 104, one or more pressure-sensitive sensors, a battery pack, and control logic, all of which can be conventional. In such an embodiment, the appearance of the upper side of deck 120' can be identical to that depicted in FIG. 1. Lower surface 124' can have a smooth contour as specifically illustrated in FIG. 9. Although the embodiment of FIG. 9 does not provide the advantage of being able to convert a stand-up wheeled vehicle between smaller and larger form factors as described above, stand-up wheeled vehicle 900 still employs an asymmetric placement of wheel 104 with respect to long dimension of deck 120' and limits the maximum value of declination angle A, such that rider confidence, control, and/or safety is enhanced.

While various embodiments have been particularly shown and described, it will be understood by those skilled in the art that various changes in form and detail may be made therein without departing from the spirit and scope of the appended claims and these alternate implementations all fall within the scope of the appended claims. For example, although embodiments have been described in which pressure-sensitive sensor(s) are generally placed to promote sideways-facing riding of a stand-up wheeled vehicle, it should be understood that pressure-sensitive sensor(s) can alternatively or additionally be placed to promote or permit forward-facing riding of a stand-up wheeled vehicle. For example, deck 120' of FIG. 9 may incorporate one or more pressure-sensitive sensors generally aligned along the Y axis with wheel well 134.

In addition, those skilled in the art will appreciate that the design parameters disclosed herein can be utilized to scale up and/or scale down the disclosed decks and stand-up wheeled vehicles in order to make embodiments of various sizes, contours, and shapes and/or for different end uses. For example, in some implementations, the wheel(s) (e.g., wheel 104) can have a relatively smaller radius, meaning that the deck (e.g., deck 120 or 120') will ride closer to the underlying substrate. As a consequence, the overall length of deck 120 along its long axis (i.e., the X axis) extending between first end 131 and second end 133 can be decreased, while still desirably limiting the angle of declination A. As one example, in one compact embodiment second length 606 extends along the X axis about as far from balance point 604 than the trailing edge of second footpad 112, and asymmetrical first length 602 extends from balance point 604 along the X axis only far enough to limit the angle of declination A within desired bounds. Similarly, embodiments can be scaled to different sizes for different uses. For example, relatively smaller embodiments may be implemented for use by children as ride-on toys, while relatively larger embodiments (e.g., longer along the X axis and/or wider along the Y axis) may be implemented for use as racing vehicles.

Further, features of various of the disclosed embodiments may be combined, as will be appreciated by those skilled in the art. References herein to an embodiment or embodiments do not necessarily refer to the same embodiment or embodiments. The terms "about" or "approximately," when used to modify quantities or ranges, are defined to mean the stated value(s) plus or minus 5%. The term "coupled" is defined to mean attachment or cooperation of members possibly through one or more intermediate members.

What is claimed is:

1. A stand-up wheeled vehicle, comprising:
- a single wheel, wherein the single wheel is electrically powered and is an only wheel on the stand-up wheeled vehicle; and
- a deck having a length configured to limit a maximum angle of declination of the deck in a forward direction of travel to less than about 20 degrees, wherein:
  - the deck has a first end and a second end and a long axis extending between the first and second ends;
  - the wheel is intermediate the first end and the second end; and
  - a length along the long axis of a first portion of the deck between the wheel and the first end is greater than a length along the long axis of a second portion of the deck between the wheel and the second end.

2. An assembly, comprising:
- a stand-up wheeled vehicle including an electrically-powered wheel and a pressure-sensitive foot pad;
- a deck having a length configured to limit a maximum angle of declination of the deck in a forward direction of travel to less than about 20 degrees, wherein the deck includes:
  - a first surface;
  - an opposing second surface;
  - a chassis disposed in the second surface, wherein the chassis has:
    - a cavity formed therein configured to receive the stand-up wheeled vehicle;
    - a pressure pad configured to transmit pressure applied to the first surface of the deck to the pressure-sensitive foot pad of the stand-up wheeled vehicle disposed in the cavity of the chassis; and
- a coupling mechanism that removably retains the stand-up wheeled vehicle in the cavity of the chassis.

3. The assembly of claim 2, wherein a contact surface area of the pressure pad with the pressure-sensitive foot pad of the stand-up wheeled vehicle disposed in the cavity of the chassis is less than an overall area of the pressure pad.

4. The assembly of claim 2, wherein the coupling mechanism comprises a manually operable latch.

5. The assembly of claim 2, wherein:
- the deck has a first end and a second end and a long axis extending between the first and second ends;
- the wheel is intermediate the first end and the second end; and
- a length along the long axis of a first portion of the deck between the wheel and the first end is greater than a length along the long axis of a second portion of the deck between the wheel and the second end.

6. A deck for a stand-up wheeled vehicle, comprising:
- a first surface;
- a second surface;
- a chassis disposed in the second surface, wherein the chassis has:
  - a cavity configured to receive therein a stand-up wheeled vehicle having a pressure-sensitive foot pad; and
  - a pressure pad configured to transmit pressure applied to the first surface to the pressure-sensitive foot pad of the stand-up wheeled vehicle disposed in the cavity of the chassis; and
- a coupling mechanism that removably retains the stand-up wheeled vehicle in the cavity of the chassis.

7. The deck of claim 6, wherein:
- the deck has a long axis extending between a first end and a second end;
- the wheel is intermediate the first end and the second end; and
- a length along the long axis of a first portion of the deck between the wheel and the first end is greater than a length along the long axis of a second portion of the deck between the wheel and the second end.

8. The deck of claim 6, wherein a contact surface area of the pressure pad with the pressure-sensitive foot pad of the stand-up wheeled vehicle disposed in the cavity of the chassis is less than an overall area of the pressure pad.

9. The deck of claim 6, wherein the coupling mechanism comprises a manually operable latch.

10. A method of converting a form factor of a stand-up wheeled vehicle, the method comprising:
- providing a deck including:
  - a first surface;
  - a second surface; and
  - a chassis disposed in the second surface, wherein the chassis has:
    - a cavity configured to receive a stand-up wheeled vehicle having a wheel and a pressure-sensitive foot pad;
    - a pressure pad configured to transmit pressure applied to the first surface to the pressure-sensitive foot pad of the stand-up wheeled vehicle disposed in the cavity of the chassis;
- inserting the stand-up wheeled vehicle in the cavity of the chassis; and
- removably retaining the stand-up wheeled vehicle in the cavity of the chassis utilizing a coupling mechanism.

11. The method of claim 10, wherein the step of providing the deck includes:
- providing the deck having:
  - a long axis extending between a first end and a second end; and
  - a first portion between the wheel of the stand-up wheeled retained in the chassis and the first end and a second portion between the wheel and the second end, wherein a length of the first portion along the long axis is greater than a length of the second portion along the long axis.

12. The method of claim 10, wherein a contact surface area of the pressure pad with the pressure-sensitive foot pad of the stand-up wheeled vehicle disposed in the cavity of the chassis is less than an overall area of the pressure pad.

13. The method of claim 10, wherein the step of removably retaining includes coupling the chassis and the stand-up wheeled vehicle utilizing a manually operable latch.

* * * * *